US005611226A

United States Patent [19]

Fata

[11] Patent Number: 5,611,226

[45] Date of Patent: Mar. 18, 1997

[54] LOCKSET

[75] Inventor: Joseph J. Fata, Moreno Valley, Calif.

[73] Assignee: Emhart Inc., Newark, Del.

[21] Appl. No.: 671,024

[22] Filed: Jun. 25, 1996

Related U.S. Application Data

[62] Division of Ser. No. 554,070, Nov. 6, 1995.

[51] Int. Cl.[6] ..... E05B 15/08

[52] U.S. Cl. ..... 70/454; 70/DIG. 59; 362/100

[58] Field of Search ..... 70/454, DIG. 59, 70/DIG. 51, 455; 362/100, 80

[56] References Cited

U.S. PATENT DOCUMENTS

| | | | |
|---|---|---|---|
| 1,128,307 | 2/1915 | Greely | 362/100 |
| 1,810,775 | 6/1931 | Martin | 362/100 |
| 1,985,483 | 12/1934 | Clarke | 362/100 |
| 2,188,264 | 1/1940 | Fordyce | 250/466.1 |
| 4,078,248 | 3/1978 | Hill | 362/100 |
| 4,234,909 | 11/1980 | Cotroneo | 362/100 |
| 4,777,570 | 11/1988 | Littles | 362/100 |
| 5,057,975 | 10/1991 | Evigan | 362/100 |
| 5,179,325 | 1/1993 | Aragon, Jr. | 315/136 |
| 5,317,889 | 6/1994 | Solovieff et al. | 70/224 |
| 5,398,175 | 3/1995 | Pea | 362/100 |

*Primary Examiner*—Steven N. Meyers
*Assistant Examiner*—Donald J. Lecher
*Attorney, Agent, or Firm*—Spencer T. Smith

[57] ABSTRACT

A lock assembly including a locking cylinder having a keyhole into which a key can be inserted, a lighting system for dispersing light energy in the area of the keyhole, including an L.E.D. light source, and a battery operated circuit for repeatedly operating the L.E.D. light source with a selected "on" time followed by a selected "off" time.

3 Claims, 2 Drawing Sheets

LOCKSET

This is application is a divisional of pending application Ser. No. 08/554,070, filed on Nov. 6, 1995.

The present invention relates to locksets such as knob or handle assemblies or deadbolt assemblies which provide a light to locate or illuminate the area of the keyhole to facilitate key insertion.

Numerous patents disclose devices for illuminating the area of the keyhole including U.S. Pat. Nos. 5,398,175, 5,179,325, 5,057,975, 4,777,570, 4,234,909, 4,078,248, 3,955,075 and 3,719,821.

It is an object of the present invention to provide a lockset with an improved illuminating structure.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figures 1, 2:
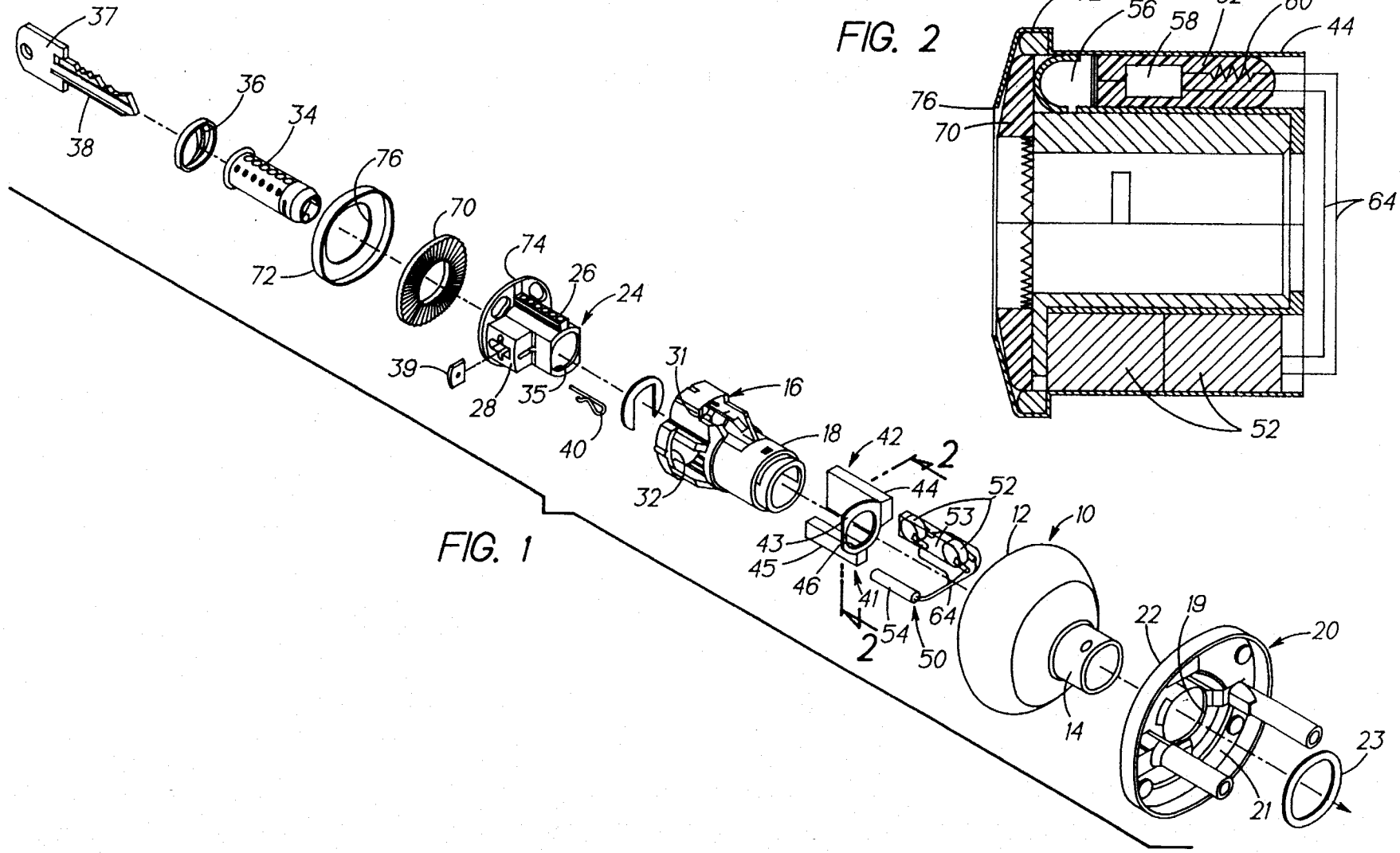
FIG. 1 is an exploded view of an exterior knob assembly of a lockset mechanism made in accordance with the teachings of the present invention.
FIG. 2 is a cross-sectional view taken along 2—2 of FIG. 1.

The exterior knob assembly includes a knob 10, which has a hand engaging front portion 12 and a rear shank portion 14. Located within the knob is an insert 16. The rear cylindrical portion 18 of the insert extends through the knob shank portion 14 and through an opening 19 in the rose assembly 20 (the rose assembly has a liner portion 21 and a cover portion 22) and is secured in place by a suitable clip 23. A locking cylinder has a cylinder body 24 which has an outwardly projecting axially extending chimney portion 26 and a 90° related outwardly projecting axially extending interconnection device 28. The cylinder body is inserted into the insert 16 with the chimney portion 26 being received by one of a pair of 180° related chimney receiving pockets 31 and with the interconnection device 28 being received by one of a pair of 180° related interconnection device receiving pockets 32. (The pocket pairs are identical and 180° related so that the locking cylinder can be installed in either of two 180° related positions to accommodate left or right handed mechanism use). The locking cylinder also has a plug 34, which presents a key way (not shown) at the front and which is inserted into a suitable bore 35 in the locking cylinder and a plug cover 36 which dresses the end of the plug.

In the preferred embodiment, the locking cylinder is removable from the front of the knob by selectively releasing the interconnection device. This is done by inserting a suitable release key 37 into the plug and rotating the key counterclockwise 90° to locate a slot 38 in the base of the key adjacent a locking bar 39 of the interconnection device. The locking bar, which is biased inwardly by a spring 40, will be retracted from its operative position where it engages the insert to prevent removal, to its retracted position in the slot thereby releasing the insert. Additional details of the exterior knob assembly are disclosed in U.S. Pat. No. 5,317,889, which is incorporated herein by reference.

A light system module 41 has a housing 42 including a bracket 43 interconnecting first 44 and second 45 chambers. The bracket has a hole 46 so that the housing 42 can be slid onto the insert cylindrical end portion 18 to locate the first chamber 44 within the empty interconnection device receiving pocket 32 (180° from the shown interconnection device receiving pocket 32) and to locate the second chamber 45 within the empty chimney receiving pocket 31 (180° from the shown chimney receiving pocket 31).

The illuminating device 50 of the light system module includes a pair of series connected batteries 52 which are supported by a plastic carrier 53 which is inserted into the first chamber 44, a light source 54 including an L.E.D. 56 (FIG. 2) operated by a basic astable switching circuit 58 and a resistor 60 sized to set a selected ratio of "on" time to "off" time which are potted in a plastic carrier 62 which is inserted into the second chamber 45 and wires 64 connecting the power supply 52 to the light source extending around the rear cylindrical portion 18 of the insert 16. Optionally, a sensor can be provided to restrict operation of the light source to daylight hours. With a 20 milliamp–2000 millicandle L.E.D., powered by a 3 volt, 160 milliamp–hour capacity power supply, a 12% duty cycle has been achieved by defining the on time as 3 milliseconds and by defining the off time as 22 milliseconds, which can power the system for longer than a year. While to the naked eye the L.E.D., in the preferred embodiment, appears to be continuously on, the ratio of "on" to "off" times can be selected by changing the value of the resistor, so that the L.E.D. is visibly blinking to further extend battery life.

The light emitted by the L.E.D. is dispersed into an annular translucent ring 70 which is sandwiched between the locking cylinder cover 72 and the end 74 of the cylinder body with the cover opening 76 being selectively sized to make an annular portion of the translucent ring 70 visible to a person operating the doorknob. As a result, light generated by the light source will be dispersed from the visible and translucent ring surrounding the key way to locate the keyway.

While the lighting module has been disclosed as a part of an exterior knob assembly, it could also be incorporated into a deadbolt or the like.

Figure 3:
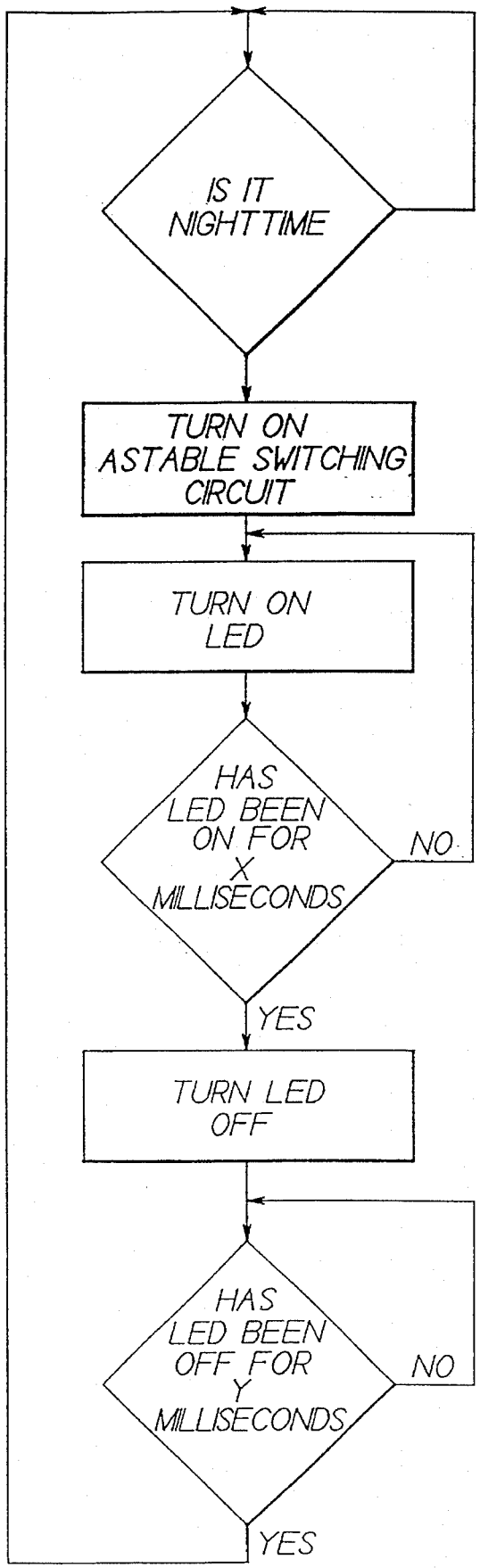
FIG. 3 is a logic diagram of the circuit controlling the illuminating device shown in FIG. 1.

As shown in FIG. 3, which illustrates nighttime only operation, a sensor (is it nighttime) determines when light is required and turns on the astable switching circuit. The astable switching circuit turns the L.E.D. on for a selected time period (X milliseconds) and then turns the L.E.D. off for a selected period (Y milliseconds). If there is no sensor, placing the batteries in the battery carrier will complete the lighting system circuit and thereby turn on the L.E.D.

What is claimed is:

1. A lock assembly comprising an exterior operator assembly including a locking cylinder including a cylinder body, an insert for receiving said cylinder body, said insert including at one end a first pair of 180° related pockets and a second pair of 180° related pockets and including at the other end a shank portion, and a lighting system including a housing having first and second chambers interconnected by a portion having a hole therein sized to receive said insert shank portion, said first and second chambers being selectively configured so that when said insert shank portion is inserted into said hole said first and second chambers can be located in one pocket of each of said pairs of pockets, light source means in said first chamber, and power supply means in said second chamber.

2. A lock assembly according to claim 1, wherein said cylinder body includes an outwardly projecting chimney selectively configured so that when said one chamber is located in one pocket of one of said pocket pairs, said chimney will be located in the other pocket of said one pocket pair.

3. A lock assembly according to claim 2, wherein said cylinder body includes an outwardly projecting interconnection device selectively configured so that when said second chamber is located in one pocket of said second of said pocket pairs, said power supply means will be located in the other pocket of said second pocket pair.

* * * * *